United States Patent [19]

Goldblatt

[11] Patent Number: 4,824,414

[45] Date of Patent: Apr. 25, 1989

[54] INFLATABLE TOY WITH HOOK AND LOOP BALL ATTACHMENT

[76] Inventor: Harold Goldblatt, 3240 N. Lakeshore Dr., Chicago, Ill. 60657

[21] Appl. No.: 176,929

[22] Filed: Apr. 4, 1988

[51] Int. Cl.[4] ..... A63H 33/00; A63H 3/06; A63B 67/00

[52] U.S. Cl. ..... 446/226; 446/4; 446/901; 273/55 A

[58] Field of Search ..... 446/901, 226, 220, 222, 446/223, 396, 387, 486, 4, 5; 273/DIG. 30, 55 A

[56] References Cited

U.S. PATENT DOCUMENTS

| | | | |
|---|---|---|---|
| D. 59,999 | 12/1921 | Zimmerman | D21/177 |
| D. 121,500 | 7/1940 | Van Valin | D21/177 |
| D. 160,782 | 11/1950 | Greene | D34/15 |
| D. 188,952 | 10/1960 | Laganella et al. | D34/15 |
| D. 244,560 | 5/1977 | Derrington | 446/901 X |
| D. 259,577 | 6/1981 | Baeza | D21/177 |
| D. 274,923 | 7/1984 | Ikeda | D21/159 |
| D. 280,534 | 9/1985 | Cassaro | D21/168 |
| 1,218,398 | 3/1917 | Gurtov | 446/369 X |
| 1,518,108 | 12/1924 | Rapp | 446/325 |
| 2,611,214 | 6/1950 | Schur | 446/325 |
| 3,163,419 | 12/1964 | Lemelson | 446/226 X |
| 3,391,933 | 7/1968 | Cooper | 446/901 X |
| 3,665,642 | 5/1972 | Horner | 446/325 |
| 3,921,331 | 11/1975 | Schatz | 446/297 |
| 4,235,042 | 11/1980 | Hills | 273/DIG. 30 X |
| 4,268,030 | 5/1981 | Richards | 446/226 X |
| 4,411,096 | 10/1983 | Smith | 446/325 |
| 4,471,565 | 9/1984 | Terzian | 446/273 |
| 4,529,390 | 7/1985 | Levy et al. | 446/220 |

FOREIGN PATENT DOCUMENTS

| | | | |
|---|---|---|---|
| 2013508 | 8/1979 | United Kingdom | 446/901 |

*Primary Examiner*—Robert A. Hafer
*Assistant Examiner*—D. Neal Muir
*Attorney, Agent, or Firm*—Laff, Whitesel, Conte & Saret

[57] ABSTRACT

An inflated toy is in a general form which is suggestive of a football player with his arm and hand in a passing position. A hook and loop fastener is on the hand of the player and on the football so that the hand may hold the ball. If the toy is tackled properly, the player may fumble the ball.

8 Claims, 1 Drawing Sheet

INFLATABLE TOY WITH HOOK AND LOOP BALL ATTACHMENT

This invention relates to toys and more particularly to inflated dolls which preferably are approximately the size of the child who plays with them.

The terms "doll" or "toy" are used herein to identify a balloon-like object, which may be made in any suitable shape and form. For example, the drawing shows a football player holding a ball; however, it could also have been shown as the Easter bunny holding an egg, an airplane carrying a bomb, or the like. Therefore, the terms "doll" or "toy" are to be broadly construed to cover any of these or similar forms.

Usually, inflated dolls of the described type have a domed or rounded bottom, filled with sand, or the like. If the child punches the doll, it rolls back and then returns to its upright position, floats, or the like. Sometimes the doll is a water toy adapted to float with and perhaps support the child. Still other inflated toys are adapted to other uses.

One drawback with this type of toy is that its use is very limited. If it is designed to be punched, that is the only way that it can be used. If it is a floating toy, the only thing that it does is to float. At the age when they play with these inflated toys, children have vivid imaginations. They are able to be very creative in the ways that they use their toys. On the other hand, even if the child is creative, there is a limit to that creativity if the doll cannot respond in any manner except to roll back and then return into an upright position, floats, or the like. Moreover, the physical contours of the inflated toy have been less than inspiring since it was merely a large balloon. This, too, limited the child's imagination.

Accordingly, an object of the invention is to provide new and improved toys, and more particularly inflated toys. Here, an object is to provide a substantially child sized toy which can be a playmate for the child. In particular, an object is to provide a more realistically appearing playmate doll.

Another object of the invention is to provide an inflatable doll which enables a more realistic play. Here an object is to provide a dolll which can do more than one thing and, therefore, enables the playing of more than one game.

In keeping with an aspect of the invention, these and other objects are accomplished by an inflatable doll having a domed or rounded base which is ballasted with sand, or the like, so that the doll may bob and weave as it is tackled. A greater realism is achieved by adding contoured parts which help to take away the balloon look. The doll has a part, such as an outstanding hand, with half of a hook and loop fastener ("Velcro") in the palm. Another and separate part of the toy, such as a football, has the other half of a hook and loop fastener on it. Therefore, the doll may catch or hold the football when the two parts of the hook and loop fastener snag each other. If the doll is tackled, the child may force it to drop the ball. Many other games may be created and played by children who think of new ways of using the toy.

A preferred embodiment of the invention is seen in the attached drawings, wherein.

Figure 4:
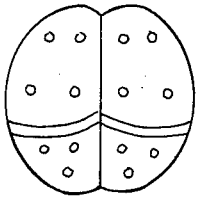
FIG. 4 is a plan view showing the bottom of the toy.

The toy is preferably made of pieces cut from sheet vinyl which are welded together to form an air tight balloon like object, here shown in the general form of a football player, by way of example. The vinyl is printed with any suitable markings to simulate a football player, complete with spiked shoes. The bottom (FIG. 4) of the toy has a somewhat domed or rounded shape and has a substantial amount of sand ballast associated therewith. The weight of the sand causes the doll to bob and weave as it is struck, or tackled. Preferably the sand and the upstanding arm and football are distributed so that the football lies over the center of gravity.

Figure 1:
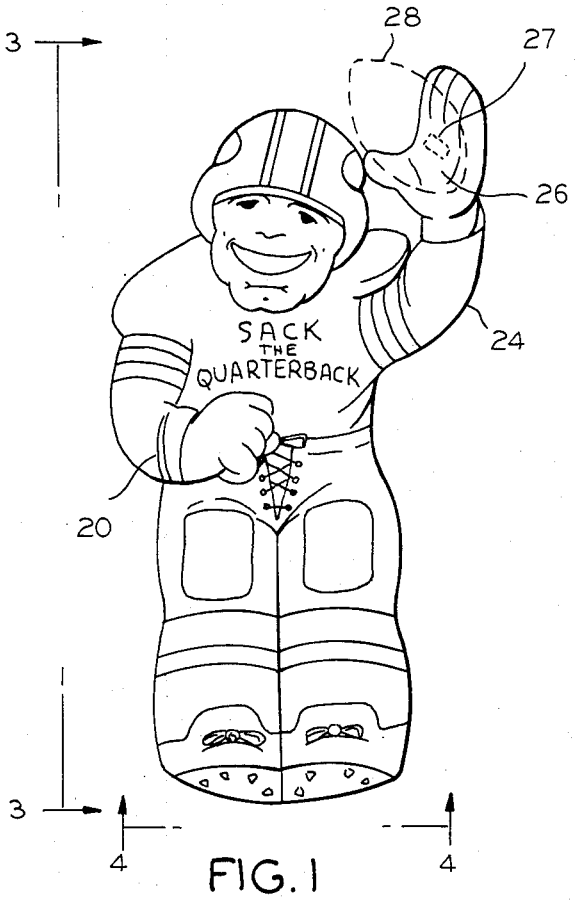
FIG. 1 is a front elevation view of the inflatable toy, with a football shown by dashed lines.
Figure 2:
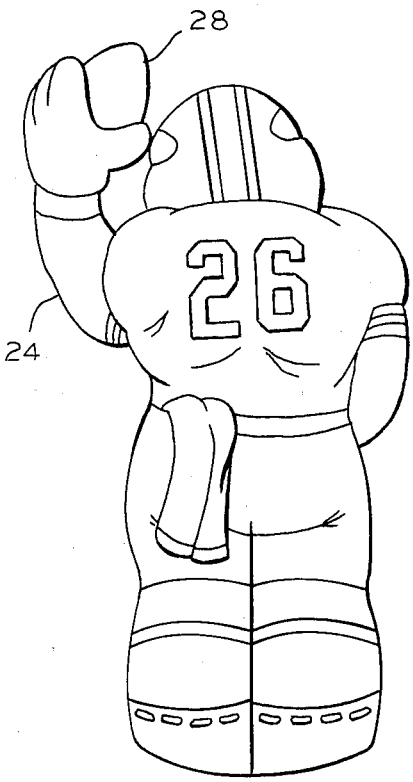
FIG. 2 is a back elevation view of the toy with a football in place.
Figure 3:
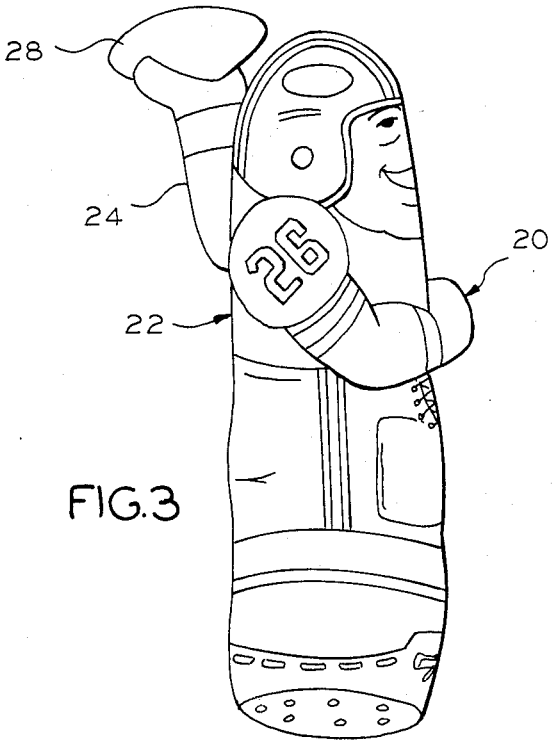
FIG. 3 is a side elevation taken along line 3—3 of FIG. 1.

The vinyl panels are shaped and dimensioned so that three dimensional contours appear on the doll. Thus, for example, the lower arm projects outwardly from the body at 20 (FIG. 3). The back of the doll tapers inwardly at the small of the back 22. An outstanding part, such as the right arm 24 is extended away from the body, and in a football passing position. Likewise, other contours may be added to further enhance a more realistic appearance.

The palm 26 of the raised hand is lined with one half of a hook and loop fastener, such as that sold under the trademark "Velcro." The other half of the hook and loop fastener is on a suitable and separate playing piece, such as the football 28. Therefore, if the football 28, or another playing piece, is placed in the hand 26, it will stick there.

To play with the toy, the child may throw a football pass into the hand 26 of the player. If the child's aim and the velocity of the ball are correct, the inflated doll will catch the ball. Once the ball is in the inflated doll's hand, the child may tackle the doll and try to cause it to fumble the ball. The child is able to create any number of rules and regulations for games with the toy. For example, it might be a "foul" for the child to use his hand to pull the football from the hand of the doll, thus forcing the child to tackle the inflated toy in a manner which flings the ball from the doll's hand.

Those who are skilled in the art will readily perceive how modifications may be made within the scope and spirit of the invention. Therefore, the appended claims should be construed to cover all equivalent structures.

The claimed invention is:

1. A toy comprising an inflated counterbalanced and closed figure with an outstretched hand, said figure being made of durable sheet material and having a domed-shaped bottom so as to bob back and forth when struck and to come to rest in an upright position, a first fastener means on said outstretched hand, and a separate ball with a second fastener means which is complementary to said first fastener, whereby said ball can be releasably attached to said hand when said fasteners are joined and may be knocked from said fibure by an impact of a child with said figure.

2. The toy of claim 1 wherein said outstretched hand and ball are positioned over the center of gravity of said figure when at rest in said upright position.

3. The toy of claim 2 and at least one part of said figure projecting in a three dimensional image.

4. An inflatable toy comprising a closed figure made of durable sheet material which can withstand impact upon bodily contact with a child , a part of said figure having a first half of a hook and loop fastener on an outside surface of said sheet material, and a separate simulated game ball having a second half of said hook and loop fastener thereon whereby said simulated ball is releasably attached to said figure when such fasteners are joined together, whereby said simulated ball may be knocked from said figure by an impact of a child with said figure, the appearance of said figure and said separate simulated game ball being coordinated to be used together, the figure having a bottom with substantially a domed shape, and ballast for causing said figure to roll back and return to an upright position when struck to form a counterbalanced figure.

5. The toy of claim 4 wherein said figure is in the form of a ball player and said part of said figure is a hand, whereby said hook and loop fastener causes said hand to hold said ball.

6. The toy of claim 4 wherein said figure is in the form of a football player said part is one hand of the figure, and said separate simulated game ball is a football.

7. The toy of claim 6 wherein the surface of said figure has a contoured surface.

8. The toy of claim 7 wherein said contoured surface is another hand of the figure.

* * * * *

UNITED STATES PATENT AND TRADEMARK OFFICE

CERTIFICATE OF CORRECTION

PATENT NO. : 4,824,414

DATED : April 25, 1989

INVENTOR(S) : Harold Goldblatt

It is certified that error appears in the above—identified patent and that said Letters Patent is hereby corrected as shown below:

Claim 1, col. 2, line 57, the word "fibure" should be --figure--.

Signed and Sealed this

Twelfth Day of December, 1989

*Attest:*

JEFFREY M. SAMUELS

*Attesting Officer*

*Acting Commissioner of Patents and Trademarks*